United States Patent [19]

Jentoft et al.

[11] Patent Number: 4,481,735

[45] Date of Patent: Nov. 13, 1984

[54] VENTILATING SKYWINDOW

[75] Inventors: Arthur P. Jentoft, Kennebunkport; Paul A. Couture, Emery Mills, both of Me.

[73] Assignee: Wasco Products, Inc., Sanford, Me.

[21] Appl. No.: 414,597

[22] Filed: Sep. 3, 1982

[51] Int. Cl.[3] ..... E05F 11/00

[52] U.S. Cl. ..... 49/325; 49/139

[58] Field of Search ..... 49/139, 140, 325, 324

[56] References Cited

U.S. PATENT DOCUMENTS 3,090,613 5/1963 Bechtold ..... 49/325

3,911,802 10/1975 Morden ..... 49/325

FOREIGN PATENT DOCUMENTS 492284 4/1953 Canada ..... 49/140

703572 3/1941 Fed. Rep. of Germany ..... 49/139

*Primary Examiner*—Kenneth Downey

*Attorney, Agent, or Firm*—Wolf, Greenfield & Sacks

[57] ABSTRACT

An operator for providing opening and closing of a skylight and described herein in a number of separate embodiments, including a first embodiment which is solely manual including a gear and sprocket drive. A second embodiment employs a combination of a manual hand crank drive along with electric motor drive. In third and fourth embodiments described herein, the operator is set up normally for manual drive but is readily adapted by replacement of the manual cover plate to electric motor drive.

10 Claims, 27 Drawing Figures

142
136
134
138
130
132
128
120
144
136
126
124

VENTILATING SKYWINDOW

BACKGROUND AND SUMMARY OF THE INVENTION

The present invention relates in general to skylights, and pertains, more particularly, to an operator used in opening and closing a skylight. There is described herein, a number of different embodiments for carrying out the principles of the present invention.

Accordingly, it is an object of the present invention to provide an improved operator construction for use in conjunction with a skylight or the like. In accordance with one aspect of the invention the operator comprises a housing, means securing the housing to the skylight and drive gear means in the housing for driving, for example, a chain or the like which is used for causing an opening and closing of the skylight. The operator also has a manual handle means and means coupling the manual handle means to the drive gear means to enable manual opening and closing. In one embodiment described herein, there is also provided electric motor means and means coupling the electric motor means to the drive gear means. The drive gear means may include a plurality of sequentially operated gears, one of which has the manual handle means coupled thereto and another one of which has the electric motor means coupled thereto. In this way, operation can be carried out either manually or electrically. More particularly, the drive gear means may comprise in one embodiment, a plurality of gears including a first gear operated from the electric motor means, a second gear driven from the first gear, a third gear driven from the second gear and from the handle means, and a fourth gear driven from the third gear. The manual handle means may comprise, in addition to a handle, an associated worm gear arrangement for coupling to the drive gear means. There is also preferably provided in the embodiments described herein, limit switch means responsive to drive gear position for controlling operation and stopping of the electric motor means at the proper positions for opening and closing the skylight.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
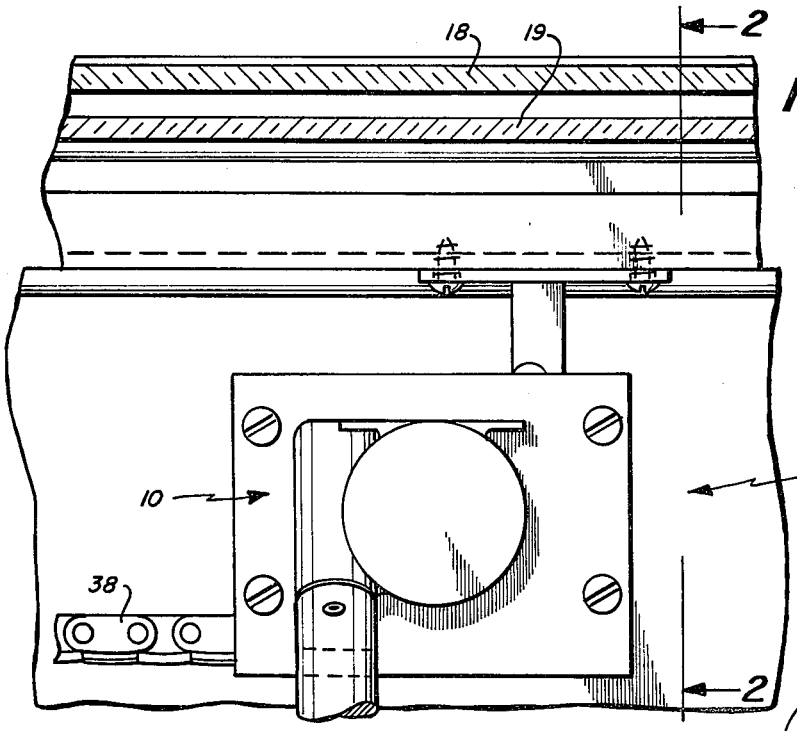
FIG. 1 is a fragmentary side elevation view showing one embodiment of an operator for a skylight.
Figure 2:
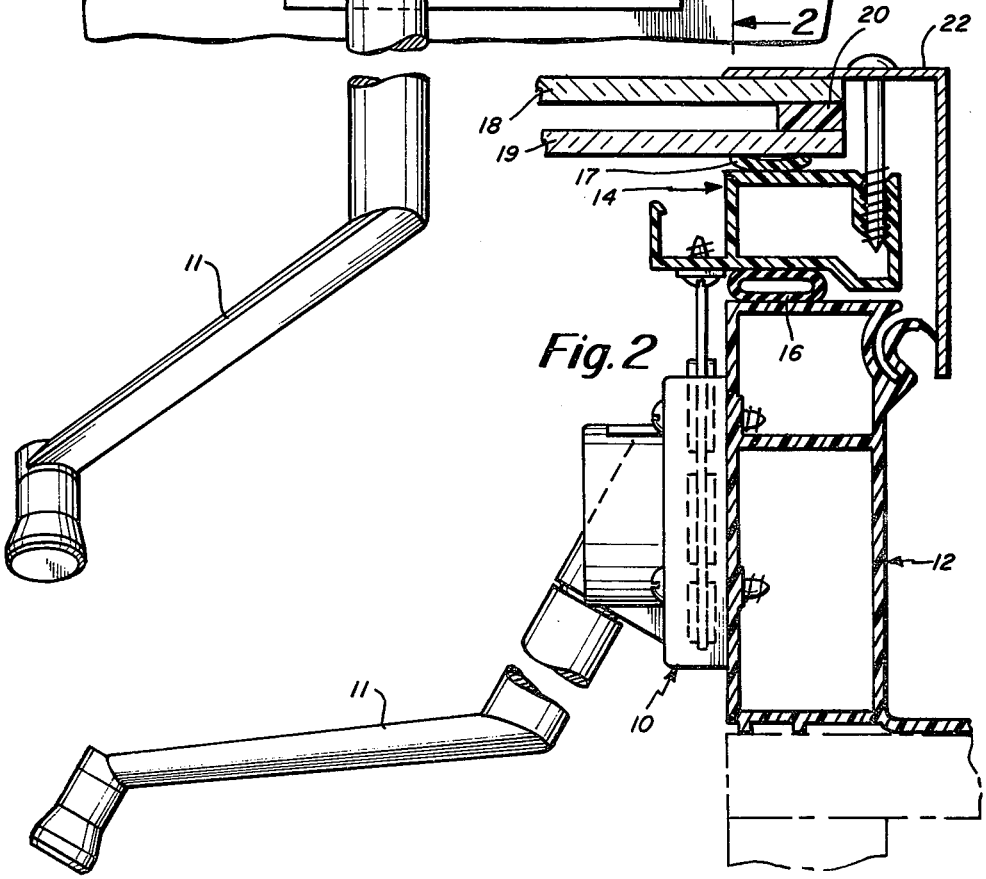
FIG. 2 is a cross-sectional view taken along line 2—2 of FIG. 1 showing one skylight construction with which the operator may be used.

Referring now to the drawings, there is shown in FIGS. 1-5 a first embodiment to the present invention in the form of a manual operator used in association with a skylight. FIGS. 1 and 2 show the operator 10 with its handle 11 secured to the base frame 12 of the skylight. Disposed over the base frame 12 is an overlying support frame 14. Intermediate the two frames 12 and 14 is provided a compressible hollow gasket 16 for sealing between the two frames. The support frames 14 carries a cup-shaped gasket 17 and disposed over the support frame 14 are a pair of glazing panels 18 and 19 having a spacing shim 20 therebetween at the periphery thereof. A retainer 22 holds the glazing panels in intimate contact with the overlying support frame 14.

Figure 3:
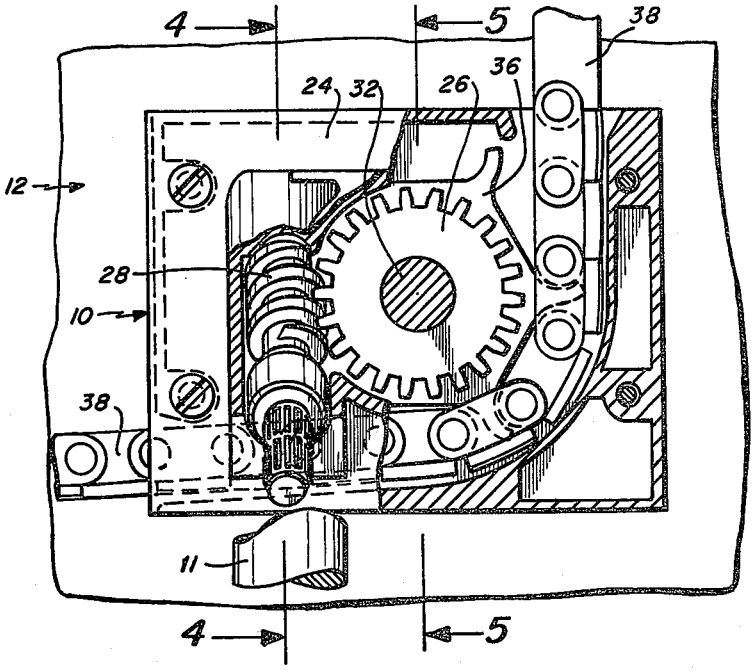
FIG. 3 is a cut-away view of the operator of FIG. 1 showing internal components thereof.
Figure 4:
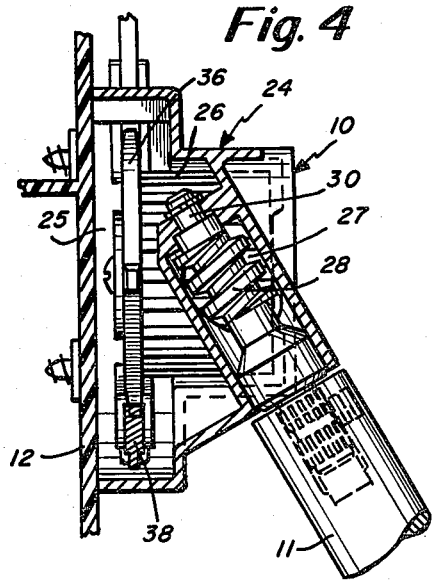
FIG. 4 is a cross-sectional view taken along line 4—4 of the operator of FIGS. 1-3.
Figure 5:
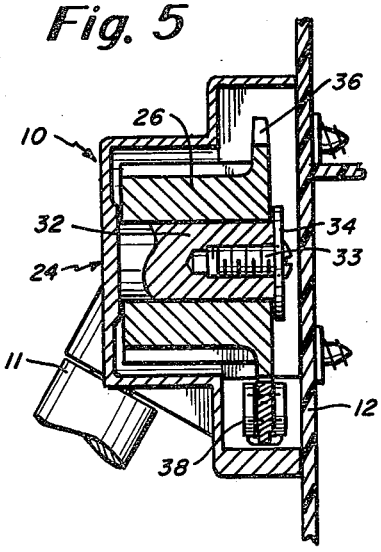
FIG. 5 is a cross-sectional view taken along line 5—5 of FIG. 3.

In FIGS. 1-5, the operator 10 comprises a housing 24 including a first chamber 25 in which is supported the gear 26 and a second chamber 27, which is cylindrical and which supports the worm gear member 28. As illustrated in FIG. 4, the handle 11 connects to the member 28 so that as the handle 11 is caused to rotate, likewise the worm gear member 28 also rotates. The end of the member 28 opposite to the handle 11 at end 30 is secured in the housing 24 but is free to rotate. As illustrated in FIG. 3, the member 28 engages with the gear 26 and thus, upon rotation of the worm gear member 28, this causes the circular gear 26 to likewise rotate on its support pin 32. The pin 32, as illustrated in FIG. 5, extends from the housing 24 end wall. The gear 26 is secured to the pin by means of the bolt 33 and associated washer 34 as illustrated in FIG. 5.

The gear 26 has associated therewith a sprocket member 36 actually integrally formed with the gear. Thus, as the handle 11 is turned, in turn, the gear 26 is driven, and likewise the sprocket 36 is driven. The sprocket 36 engages the chain 38. The chain 38 may be a conventional link chain as illustrated in the drawing. Although not illustrated in the drawing, the movement of the chain 38 causes an opening and closing of the skylight. This involves movement along at least some sides of the skylight of the overlying support frame 14 relative to the fixed base frame 12.

Figure 6:
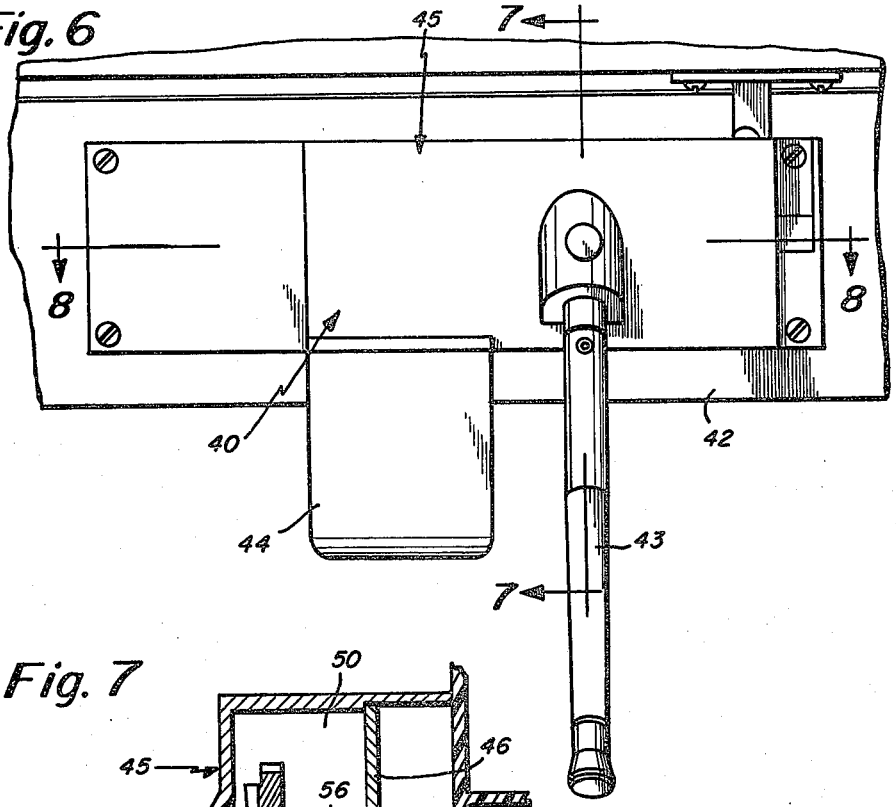
FIG. 6 is a side elevation view of a second embodiment of an operator that is operated either manually or electrically.
Figure 7:
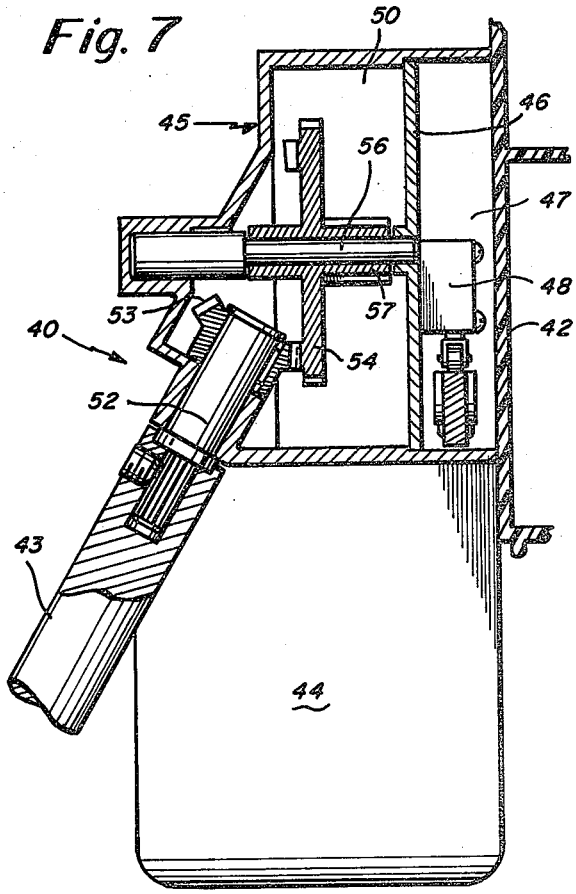
FIG. 7 is a cross-section view of the embodiment of FIG. 6 as taken along line 7—7 of FIG. 6.
Figure 8:
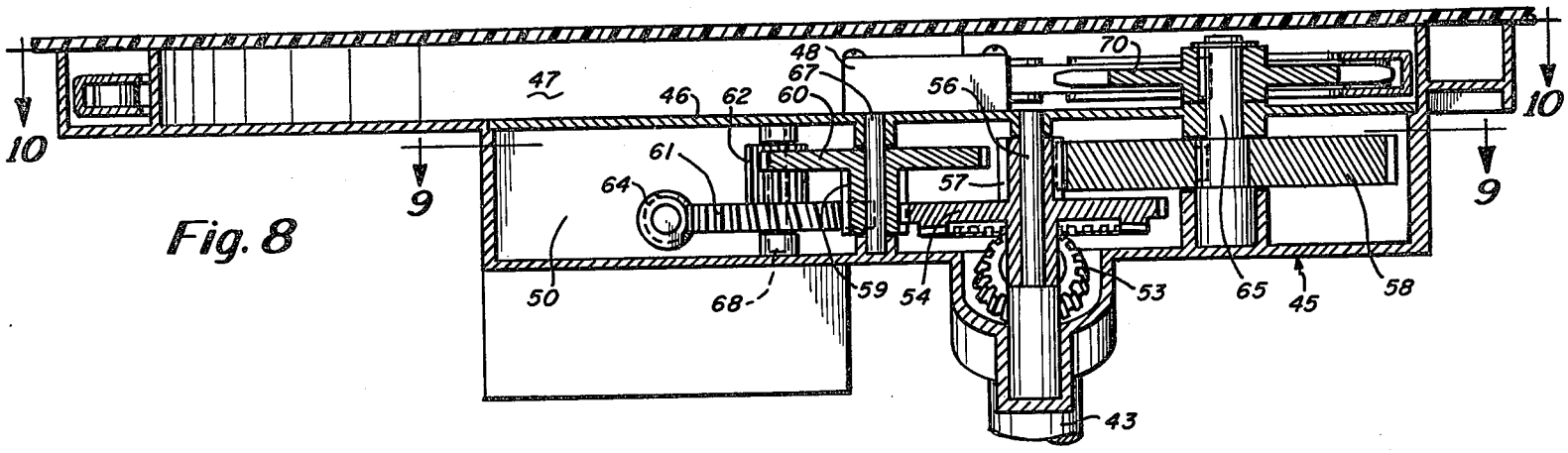
FIG. 8 is a cross-sectional view taken along line 8—8 of FIG. 6.
Figure 9:
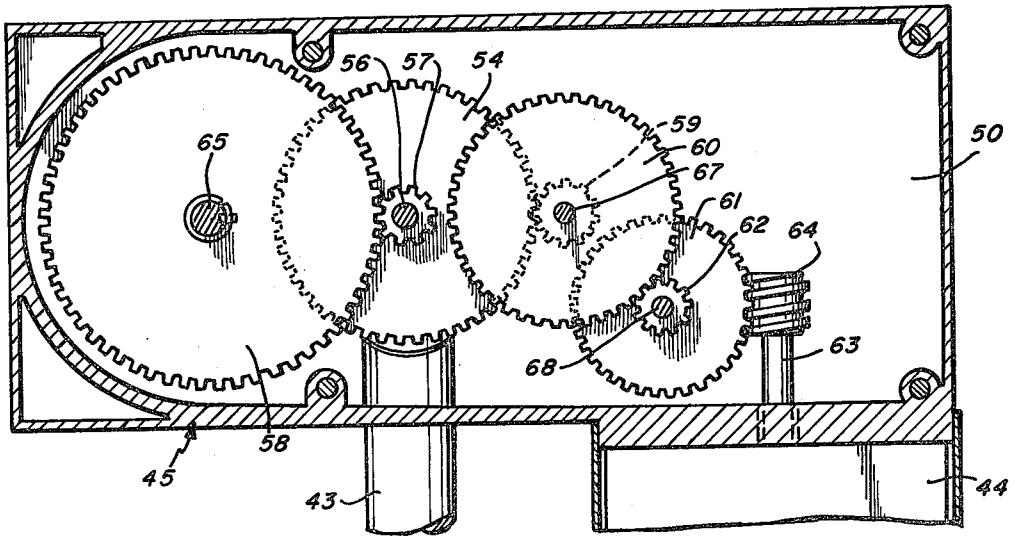
FIG. 9 is a cross-sectional view taken along line 9—9 of FIG. 8.
Figure 10:
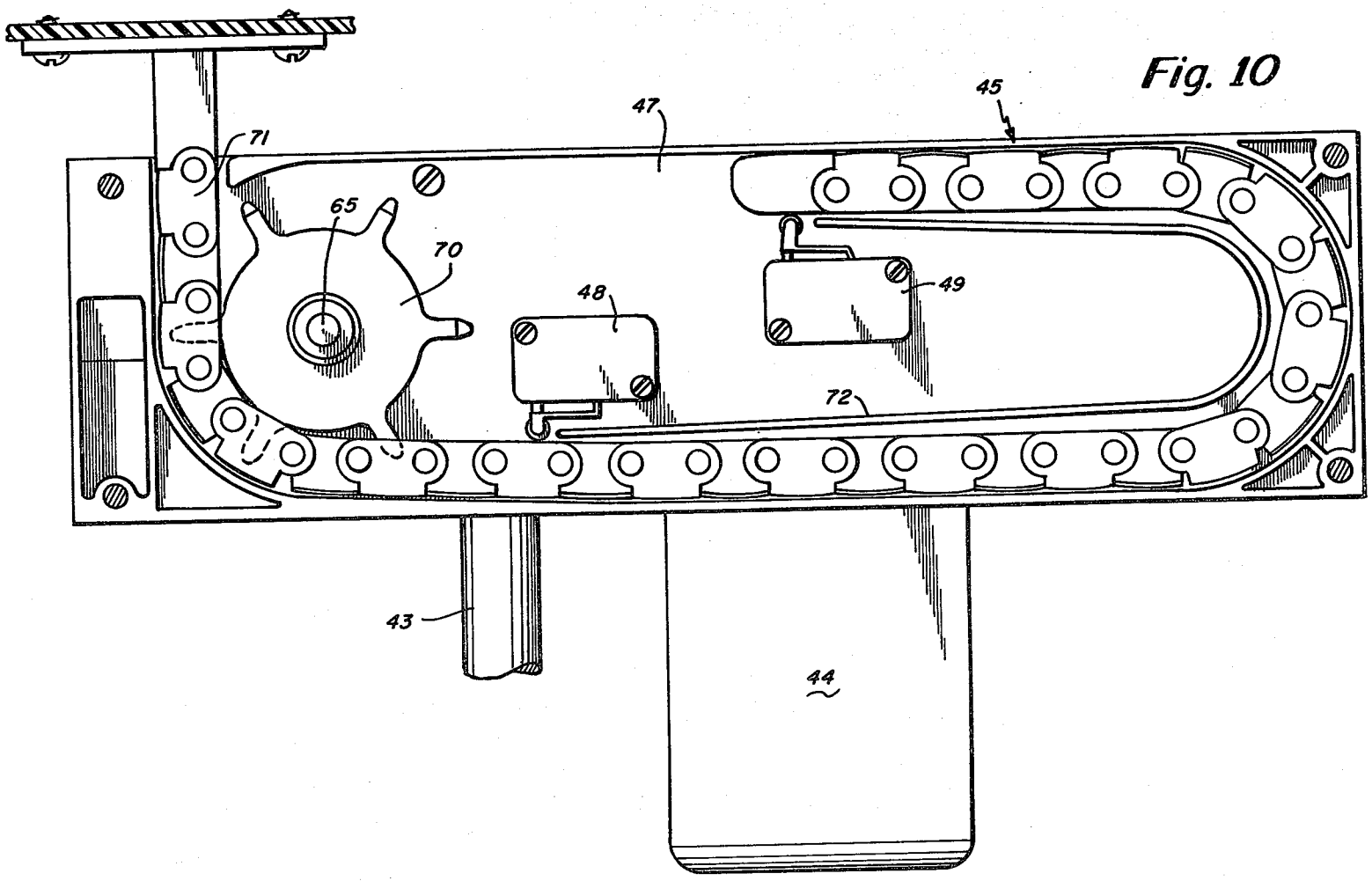
FIG. 10 is a schematic view similar to the one shown in FIG. 6 showing operation including the up and down limit switches.
Figure 11:
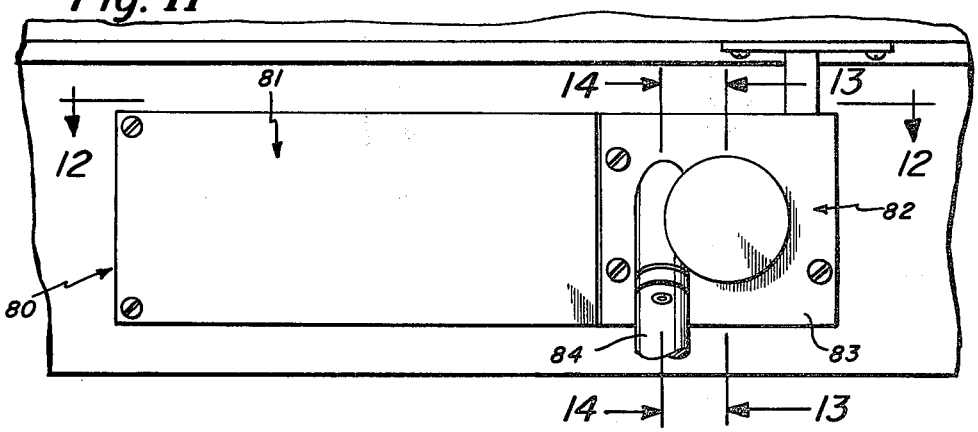
FIG. 11 is a side elevation view of still a third embodiment of the present invention which is primarily set up for manual operation but which is readily converted and adapted for conversion to electric drive.
Figure 12:
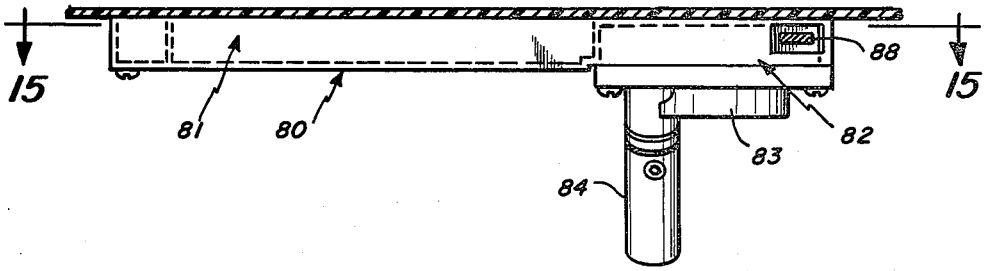
FIG. 12 is a view taken along line 12—12 of FIG. 11.

FIGS. 6–10 show another embodiment of the present invention which is a preferred embodiment in that it shows a structure capable of either manual or electrical operation. Thus, in FIG. 6 there is shown the operator in association with a skylight frame 42. The skylight frame may be of the type depicted in FIGS. 1 and 2 and the means for securing the operator may be substantially the same as illustrated hereinbefore. The operator 40 as illustrated in FIGS. 6 and 7 is operated manually by means of a handle 43 or it may alternately be operated from an electric motor 44. The operator 40 comprises a main housing 45 which is separated by wall 46, as illustrated in FIGS. 7 and 8, into basically two compartments including a first compartment 47 in which are supported limit switches 48 and 49. Reference is also made to FIG. 10 which shows these limit switches 48 and 49 for controlling the operation particularly with reference to electric motor drive. The housing 45 also includes a second compartment 50 in which are disposed the plurality of gears illustrated in FIGS. 8 and 9 and discussed in more detail hereinafter.

FIG. 7 shows the basic input manual drive. The handle 43 interconnects with a drive member 52 which supports at its end opposite to the handle 43, a bevel gear 53 which is mounted for engagement with gear 54. Gear 54 is supported on the support shaft 56 as illustrated in FIGS. 7 and 8. The gear 54 has associated therewith, a gear end 57 which engages with the output gear 58 illustrated in FIG. 8.

Thus, the gear 54 is driven manually from the bevel gear 53 for manual operation and is also driven automatically as also illustrated in FIG. 9, from the pinion gear 59 by way of large gears 60 and 61 and further pinion gear 62. As illustrated in FIG. 9, it is noted that the output shaft 63 from the motor 44 supports a worm gear 64 which in turn engages with the large gear 61 for driving the gear 61 and in turn driving its associated pinion gear 62.

Each of the gears depicted in FIGS. 8 and 9 are supported in a conventional manner on shafts supported between opposite walls of the housing 45. These shafts include shafts 65, 56, 67 and 68.

As mentioned previously, the limit switches 48 and 49 are disposed in the compartment 47. The output drive sprocket 70 which couples to the shaft 65 is also supported within compartment 47. The sprocket 70, as particularly illustrated in FIG. 10, engages with the chain 71 for driving the chain. As mentioned previously, this causes an opening of the skylight. For operating the limit switches 48 and 49, there is provided an actuating bar 72 associated with the chain and which causes tripping of the respective switches to provide signals to the motor 44 for controlling the motor so as to interrupt its operation when the skylight is to its desired open position or is fully closed.

Figure 13:
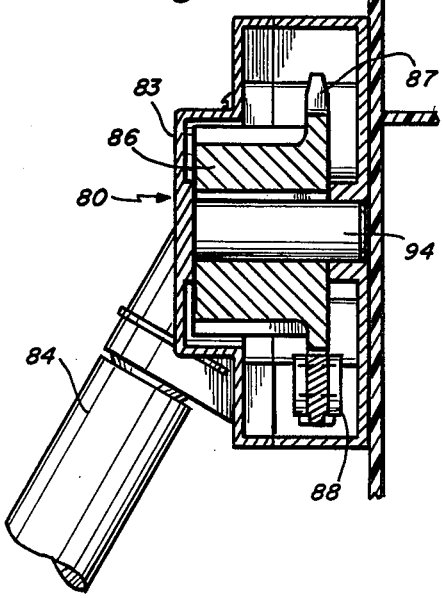
FIG. 13 is a cross-sectional view taken along line 13—13 of FIG. 11.
Figure 14:
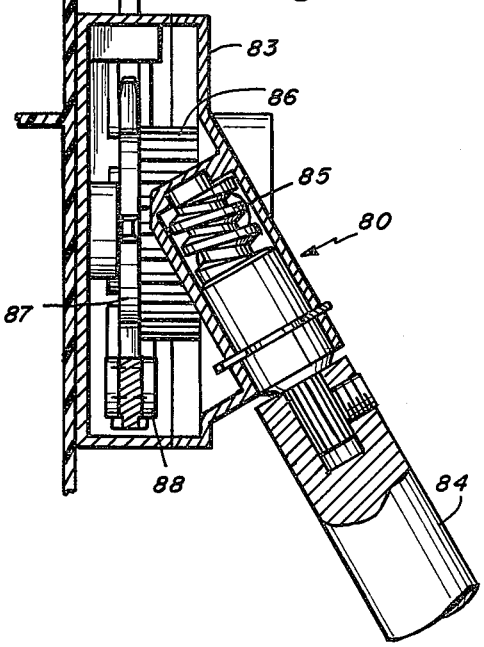
FIG. 14 is a cross-sectional view taken along line 14—14 of FIG. 11.

FIGS. 11–22 show another embodiment of the present invention which shows a manual crank for manual operation but is readily converted to electric drive simply by removal of a manual cover plate and substitution of a drive motor. Referring now to this third embodiment, there is shown an operator 80 which is basically separated into a sensing section 81 and a drive section 82. FIGS. 11–15 show the basic set-up for manual operation with the manual cover plate 83 secured in position. Thus, of course, for manual operation there is provided a handle or crank 84 which couples by way of worm gear 85 to the circular gear 86. The construction shown in FIGS. 13 and 14 is substantially identical to that previously described in FIGS. 4 and 5. Thus, the gear 86 has associated therewith, a sprocket 87 which provides drive for the chain 88. Because this construction has been described previously in connection with FIGS. 4 and 5, further detail is not deemed necessary herein.

Figure 15:
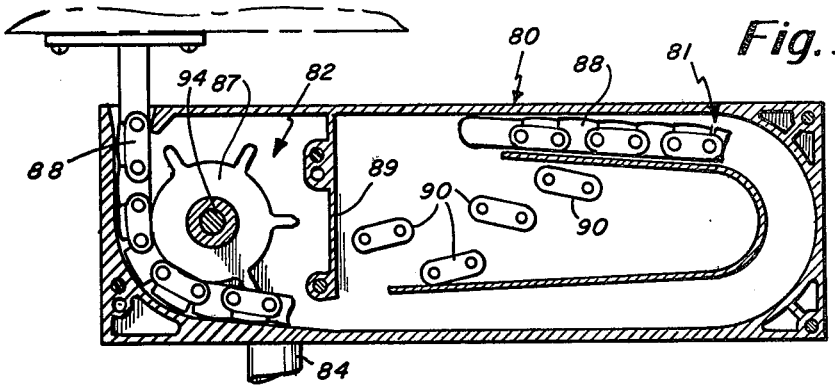
FIG. 15 is a cross-sectional view taken along line 15—15 of FIG. 12.

FIG. 15 shows the operator with its two separate sections demarcated by the wall 89. The drive section 82 is shown including the sprocket 87 for driving the chain 88. In the sensing section 81 there are provided a series of adapter plates 90 which are provided for the mounting of small limit switches of the microswitch type. In FIG. 15 the switches are not shown but the adapter plates are. For manual operation the limit switches are not necessary but the apparaus is provided with the necessary plates for the mounting thereof when it is desired to convert to manual operation to electric motor drive operation.

Figure 16:
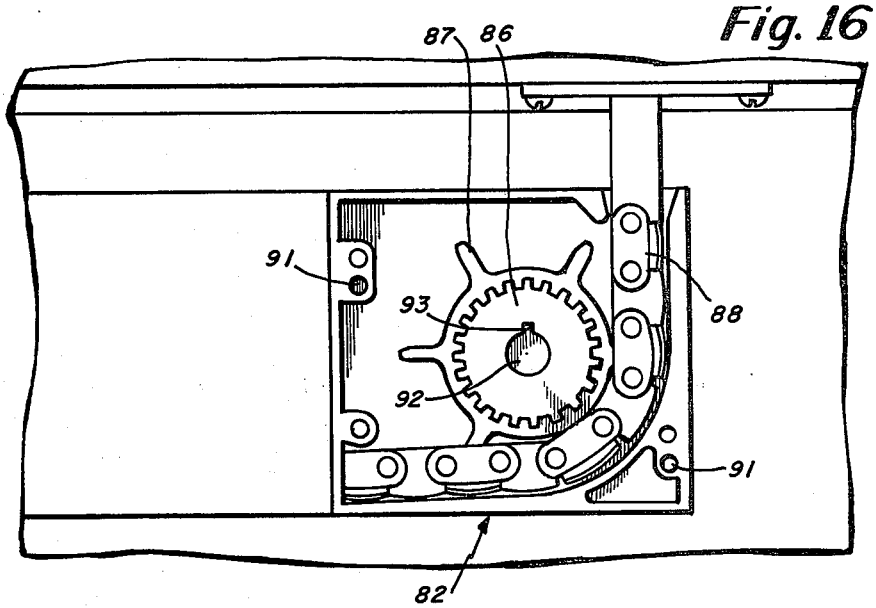
FIG. 16 is a view similar to that shown in FIG. 11 but with the manual cover plate removed so as to enable adaptation to electric drive.

FIG. 16 shows primarily the drive section 82 of the operator with the manual cover plate 83 removed to show the internal components of the apparatus including the gear 86 and associated sprocket 87 along with the chain 88 driven from the sprocket 87. With the manual cover plate removed, it is noted tha there are also provided separate holes 91 in the housing which, as explained hereinafter, are for accommodating studs to properly align the electric motor apparatus when substituted for the manual apparatus. However, when a substitution is made, the same gear 86 is used as was used with the manual crank. FIG. 16 also shows the partially open gear opening 92 with associated keyway 93 for accepting the electric motor shaft.

Figure 17:
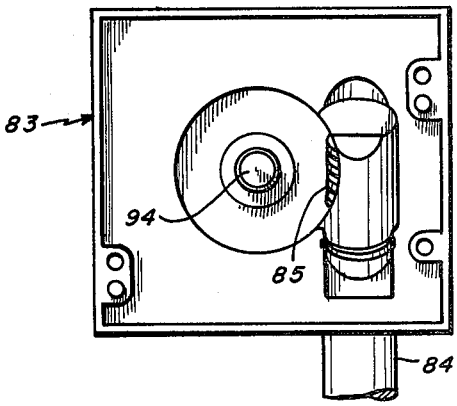
FIG. 17 is a rear view of the manual drive in the area of the manual cover plate.

FIG. 17 is the reverse side of the manual cover plate 83 showing the hand crank 84 and associated worm gear 85. FIG. 17 also shows the shaft 94 also depicted in FIG. 13. In removing the manual cover plate, the shaft 94 along with the handle and associated gear 85 are also removed therewith. It can be readily seen from FIG. 14 that by removing the cover plate 83 the entire handle and associated worm gear 85 are also removed.

Figure 18:
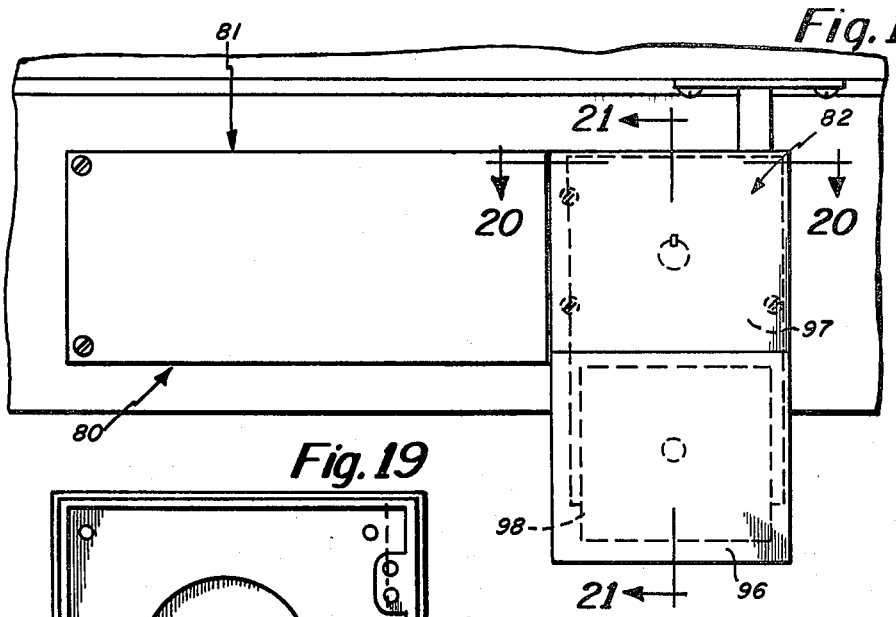
FIG. 18 is a view similar to that shown in FIG. 11 but with the manual crank now removed and replaced by an electric motor.
Figure 19:
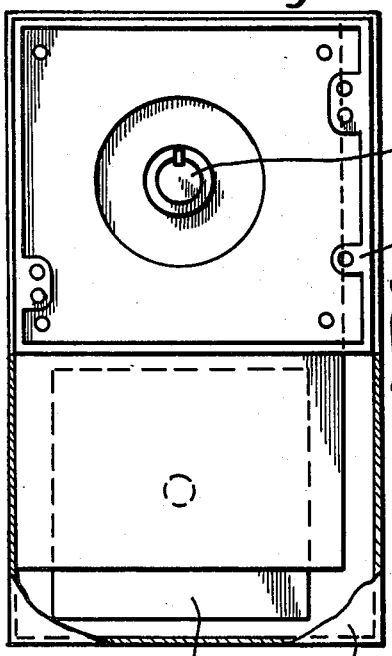
FIG. 19 shows the electric motor cover, gear drive and adapter plate.

FIG. 18 shows the operator 80 with its sensing section 81 and its drive section 82. However, now the manual cover plate has been removed and electric drive apparatus have been substituted therefor. FIG. 18 shows the electric cover plate 96. FIG. 18 also shows, in dotted outline, the adapter plate 97 and the electric motor 98. In the remaining FIGS. 19–21, the coupling is shown from the motor 98 by way of its output shaft 99 to a gear reduction drive mechanism 100. A mechanism 100 may be of conventional design and simply provides for gear reduction from the motor 98 to the output drive shaft 101 from mechanism 100. It is the gear 86 as illustrated in FIG. 21, that receives the output drive shaft 101. FIG. 21 also shows the key 102 which is used to secure the gear and drive shaft so that the gear will rotate properly upon rotation of the shaft 101.

Figure 20:
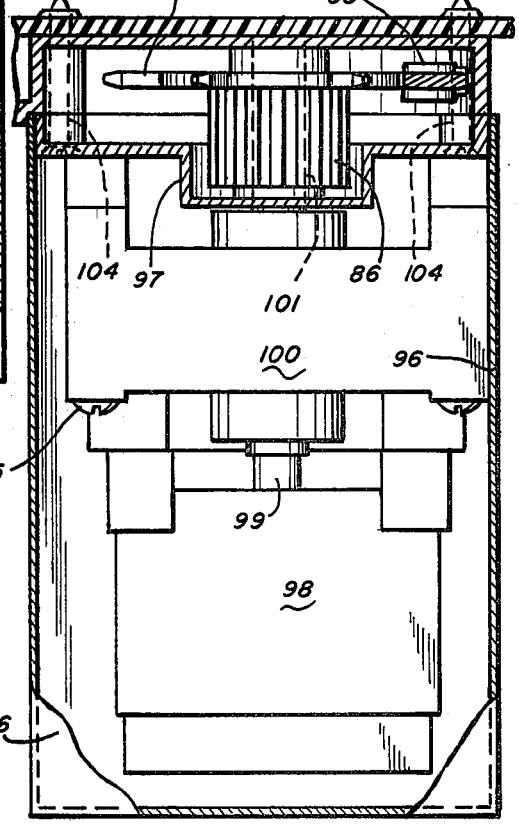
FIG. 20 is a cross-sectional view taken along line 20—20 of FIG. 18.
Figure 21:
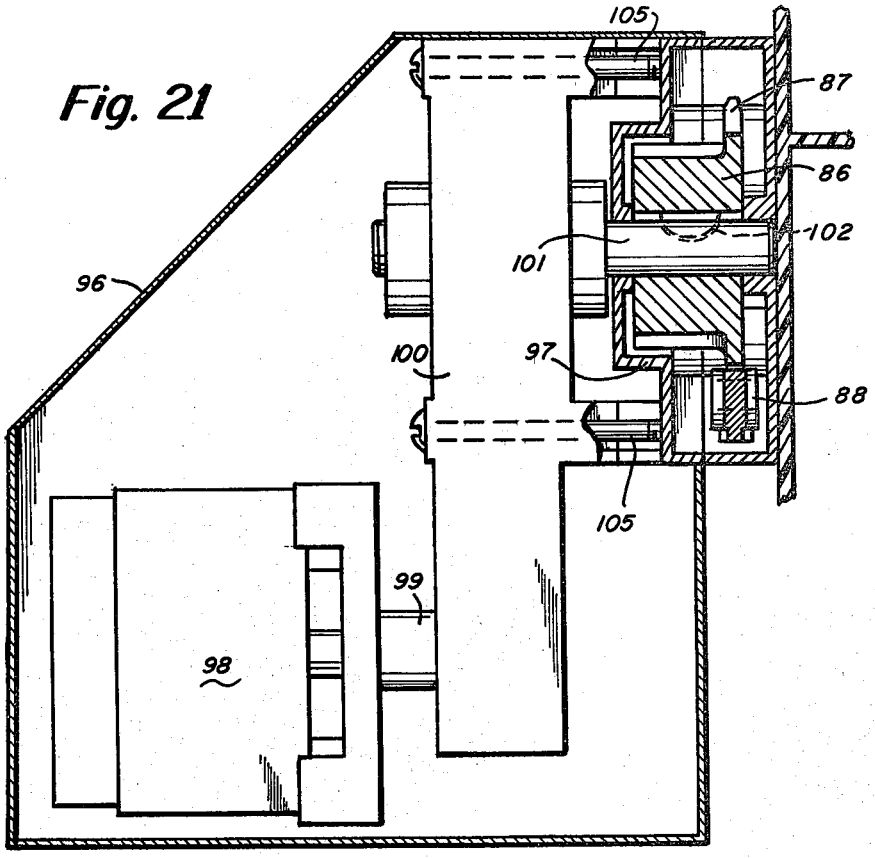
FIG. 21 is a cross-sectional view taken along line 21—21 of FIG. 18.

The adapter plate 97 has a central opening for receiving the drive shaft 101 and as illustrated in FIG. 20 is secured to the stationary half of the operator housing by means of securing bolts 104. The drive motor 98 and the gear reduction mechanism 100 are supported as a unit from the adapter plate by means of elongated bolts or screws 105 shown in FIGS. 20 and 21.

Thus, in the third embodiment described herein, once the adapter plate 97 is secured, then the motor and associated drive mechanism may be supported therefrom with the output drive shaft 101 being used to drive the gear 86. The cover 96 then covers the entire mechanism.

Figure 22:
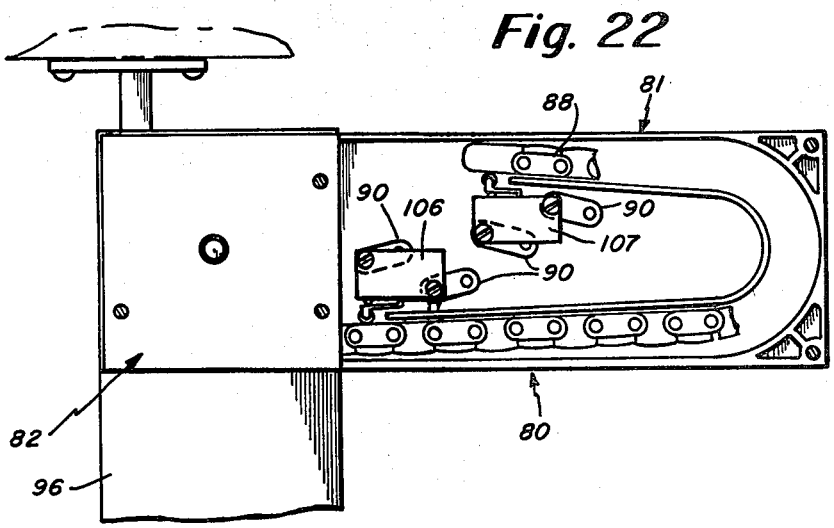
FIG. 22 is a view similar to FIG. 10 for this third embodiment of the present invention showing the use of limit switches for motor control.
Figure 23:
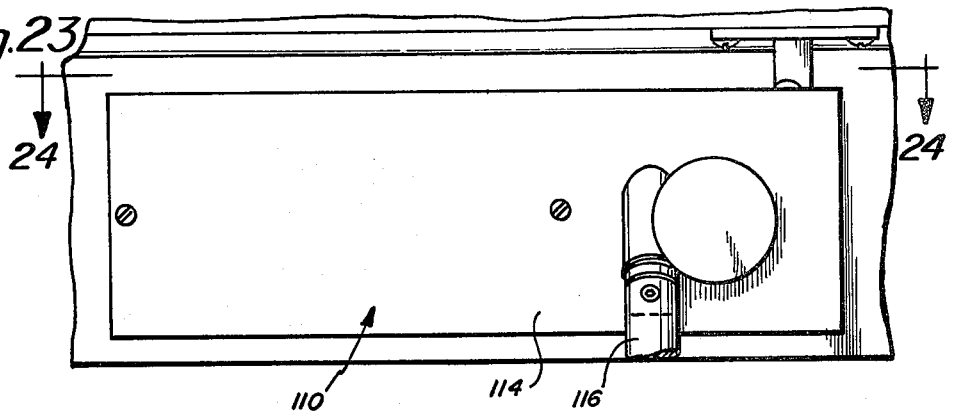
FIG. 23 is a plan elevation view of a fourth embodiment of the present invention that is for manual operation but is readily adapted for electrical drive.
Figure 24:
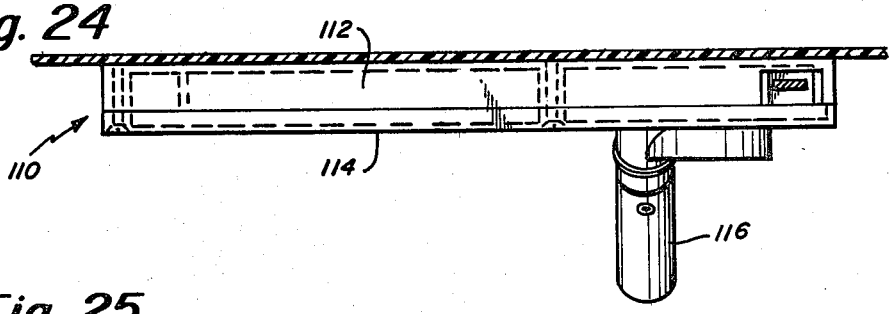
FIG. 24 is a cross-sectional view taken along line 24—24 of FIG. 23.

FIG. 22 illustrates the manner in which the microswitches 106 and 107 may be supported from the aforementioned adapter plates 90. These microswitches are used for electrical drive operation.

FIGS. 23–27 show a fourth embodiment of the present invention. This embodiment is similar to the one shown in FIGS. 11–22. In this embodiment, the operator is normally set up for manual operation but is readily adapted to electrical drive. In the embodiment shown in FIG. 23, instead of replacing only a portion of the manual cover plate, the entire cover plate is replaced. Thus, in FIGS. 23 and 24, there is shown the operator 110 including a fixed housing 112 and a removable manual cover plate 114. At one side of the cover plate 114 is disposed the hand crank 116. The hand crank has associated therewith, a drive gear such as the drive gear 85 shown in FIG. 14. Because this drive has been described previously, it has not been shown in this fourth embodiment.

Figure 25:
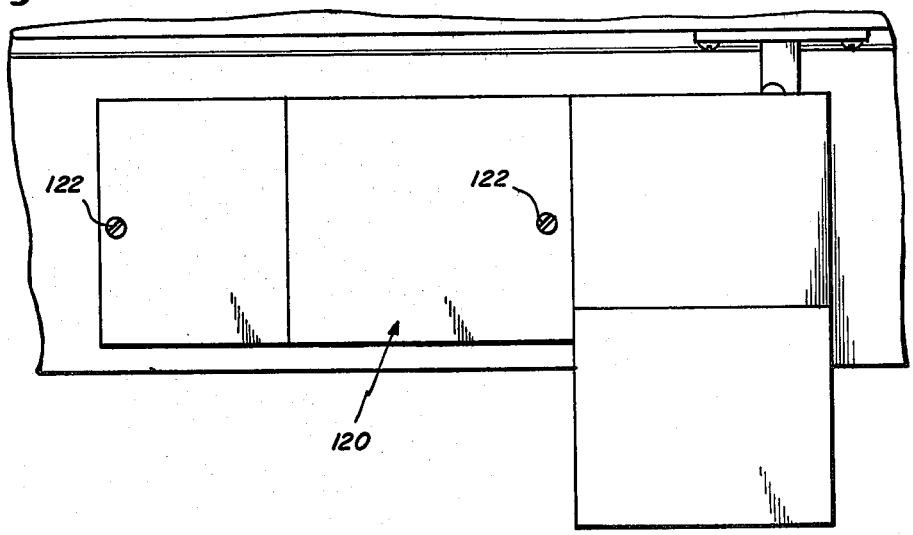
FIG. 25 shows the operator of FIG. 23 with the electrical apparatus substituted for the manual apparatus as in the previous embodiment.
Figure 26:
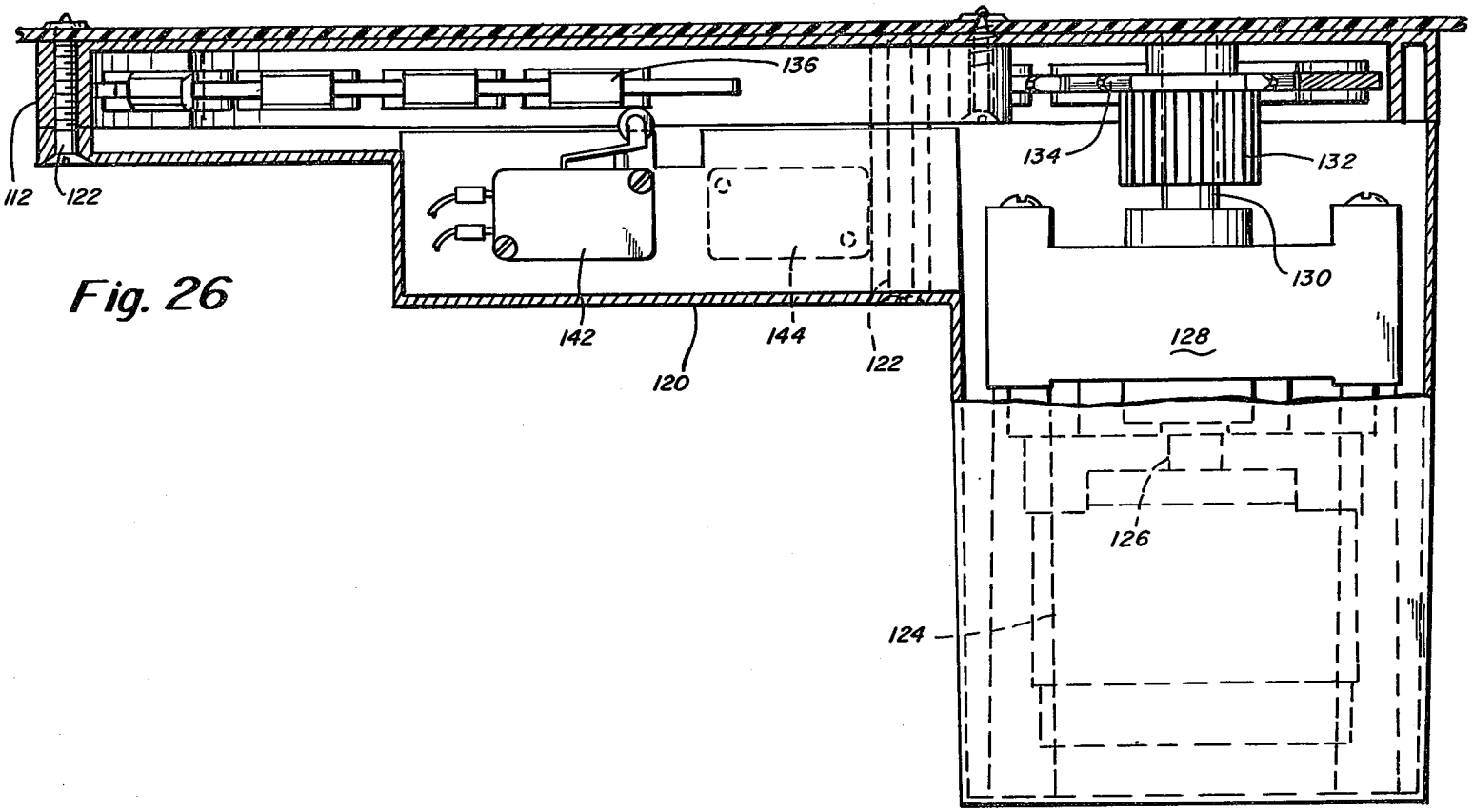
FIG. 26 is a cross-sectional view showing the internal arrangement for the electric motor construction.
Figure 27:
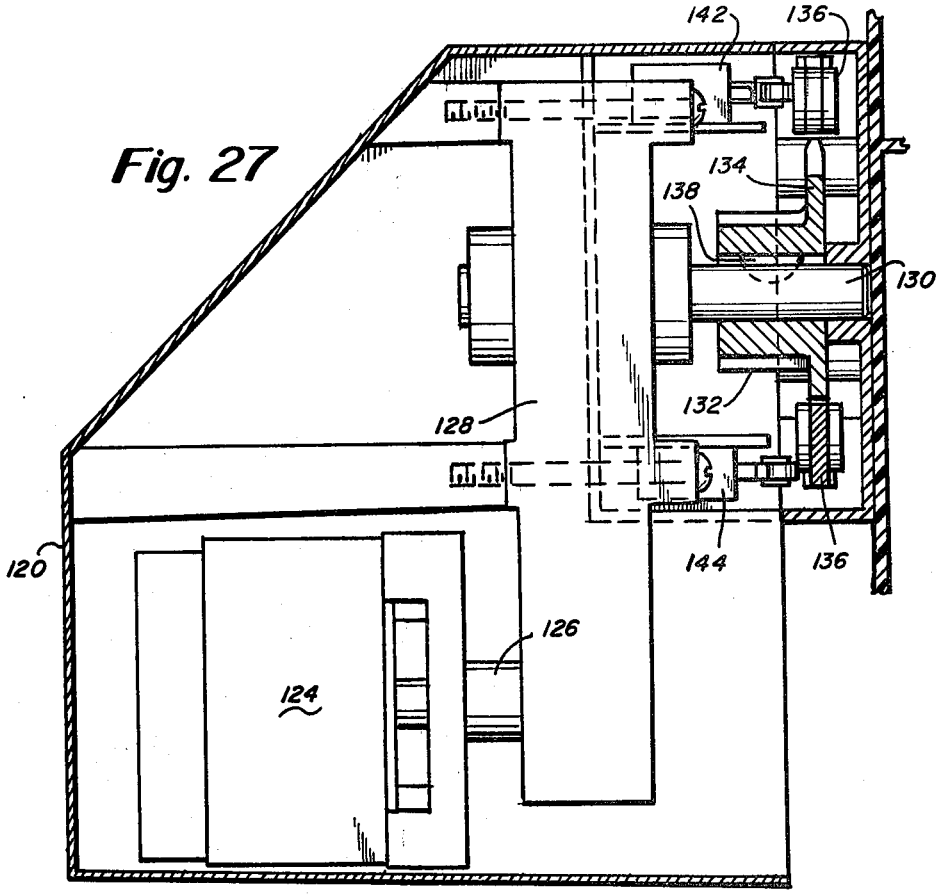
FIG. 27 is a further cross-sectional view showing the electric motor drive.

FIG. 25 shows the manual cover plate 114 having been removed and replaced by the electric drive housing 120. FIGS. 26 and 27 also show the electric motor cover 120. The cover 120 is secured to the fixed housing 112 by means of screws 122. As with the just previous embodiment, contained within the cover 120, is an electric motor 124, having an output shaft 126 coupling to a gear reduction mechanism 128. This gear reduction mechanism has an output drive shaft 130 illustrated in FIGS. 26 and 27 that couples to the drive gear 132. The drive gear 132 has integrally associated therewith the sprocket 134. The sprocket 134 supports and drives the chain 136. There is provided a key 138 for interlocking the drive shaft from the speed reduction mechanism with the gear 132.

As indicated in FIG. 26, the housing cover 120 also contains in one section thereof, the microswitches 142 and 144 for controlling movement of the chain under control of the motor 124 as these switches are actuated.

Having described a limited number of embodiments of the present invention, it should now be apparent to those skilled in the art that numerous other embodiments are contemplated as falling within the scope of this invention.

What is claimed is:

1. An operator for a skylight or the like comprising:
a housing,
means securing the housing to the skylight,
drive gear means in the housing for driving a means for causing the skylight to open and close,
manual handle means,
means coupling the manual handle means to the drive gear means to enable manual opening and closing,
electric motor means,
and means coupling the electric motor means to the drive gear means,
said drive gear means including a plurality of sequentially operated gears one of which has the manual handle means coupled thereto and another one of which has the electric motor means coupled thereto,
and means for rotationally supporting said plurality of gears with the one and another gears being supported by separated parallel-disposed spaced support shafts and with the one and another gears being arranged in parallel planes.

2. An operator as set forth in claim 1 including an output drive gear with the one gear disposed between the output drive gear and the said another gear.

3. An operator as set forth in claim 1 wherein said manual handle means is removable and replaceable by the electric motor means.

4. An operator as set forth in claim 1 wherein said drive gear means further comprises a third gear driven from the one gear and from the handle means, and a fourth gear driven from the third gear.

5. An operator as set forth in claim 1 wherein said manual handle means comprises a handle and associated worm gear means for driving the drive gear means.

6. An operator as set forth in claim 1 including limit switch means responsive to drive gear position for controlling operation and stopping of the electric motor means.

7. An operator as set forth in claim 1 including a removeable manual crank cover carrying the handle means.

8. An operator as set forth in claim 1 wherein said means coupling the manual handle means to said one gear comprises a handle shaft and a bevel gear on the shaft and engageable with said one gear.

9. An operator as set forth in claim 8 including at least a third gear between said one and another gears.

10. An operator as set forth in claim 9 including a third and fourth gears providing a gear train coupling from the bevel gear to said fourth gear, said one gear being disposed between said third and fourth gears.

* * * * *